US006594962B2

(12) United States Patent
Pardue

(10) Patent No.: US 6,594,962 B2
(45) Date of Patent: Jul. 22, 2003

(54) METHOD AND APPARATUS FOR MOUNTING A PRE-CAST PANEL TO A STRUCTURE

(76) Inventor: William Pardue, 9625 SW. Tualatin-Sherwood Rd., Tualatin, OR (US) 97062

( * ) Notice: Subject to any disclaimer, the term of this patent is extended or adjusted under 35 U.S.C. 154(b) by 0 days.

(21) Appl. No.: 09/888,844

(22) Filed: Jun. 22, 2001

(65) Prior Publication Data

US 2002/0194798 A1 Dec. 26, 2002

(51) Int. Cl.[7] ..... E04H 1/00
(52) U.S. Cl. ..... 52/235; 52/474; 52/475.1
(58) Field of Search ..... 52/235, 482, 474, 52/475.1; 248/231.5, 237; 182/3

(56) References Cited

U.S. PATENT DOCUMENTS

| | | | | |
|---|---|---|---|---|
| 3,465,996 A | | 9/1969 | Von Wedel | |
| 3,715,850 A | | 2/1973 | Chambers | |
| 3,786,605 A | * | 1/1974 | Winfrey | 52/235 |
| 4,021,989 A | | 5/1977 | Hala | |
| 4,768,321 A | * | 9/1988 | Crandell | 52/235 |
| 4,979,344 A | * | 12/1990 | Kusunoki | 52/235 |
| 5,067,292 A | * | 11/1991 | Finean | 52/235 |
| 5,077,947 A | * | 1/1992 | Takeda | 52/235 |

FOREIGN PATENT DOCUMENTS

| | | |
|---|---|---|
| CH | 569 159 | 6/1973 |
| DE | 2009 682 | 2/1970 |

OTHER PUBLICATIONS

Declaration of William Pardue, signed Sep. 21, 2001.

* cited by examiner

*Primary Examiner*—Carl D. Friedman
*Assistant Examiner*—Nahid Amiri
(74) *Attorney, Agent, or Firm*—Birdwell, Janke & Durando, PLC

(57) ABSTRACT

A method and apparatus for mounting pre-cast panels to a structure. A pocket in the pre-cast panel extends into a side thereof and has a ceiling surface adapted to rest on a height-adjustable member such as the head of a bolt threadably received in an extendable member attached to a side of the structure to which the panel is to be mounted. The extendable member is carried by a base member mounted to the structure, the base member supporting the extendable member so that the extendable member is enabled to extend along an axis and move inwardly and outwardly relative to the base portion along the axis. Preferably, the extendable member is further constrained by the base member so that the extendable member is not permitted to rotate substantially about the axis.

16 Claims, 1 Drawing Sheet

METHOD AND APPARATUS FOR MOUNTING A PRE-CAST PANEL TO A STRUCTURE

BACKGROUND OF THE INVENTION

The present invention relates to a method and apparatus for mounting a pre-cast panel, such as a pre-cast concrete or brick facade, to a structure, such as a building. More particularly, the invention relates to mounting such panels in a manner that facilitates positioning the panel on the structure.

A problem in mounting pre-cast panels such as concrete or brick facades to buildings is that the panels are very heavy, and are therefore difficult to position accurately for proper alignment to the building. This is especially the case in high-rise buildings where the panels must be hoisted to great heights.

According to a preferred prior art scheme for mounting such panels, the panels are provided with a recess or pocket extending into a side thereof and having a ceiling surface adapted to rest on the head of a vertically oriented bolt threadably received in a steel member attached to a side of the building to which the panel is to be mounted. With the panel roughly in position, threading the bolt in one direction or the other raises or lowers the panel to position the panel vertically.

A problem remaining, however, is that there is no provision to facilitate precise adjustment of the position of the panel inwardly toward the building and outwardly away from the building. Von Wedel, U.S. Pat. No. 3,465,996 proposes a "universal connecting arrangement" that provides for adjusting of face or cover plates on building walls inwardly and outwardly. An angle bracket and a Z-shaped bracket are welded to one another and secured to the wall of the structure. The brackets define a longitudinally extending glide way on which rests an intermediate member of box-shaped cross-section. The intermediate member is provided on its upper most face with a longitudinally extending slot which is inclined away from the wall. A screw extending from a bracket attached to the face plate extends into this slot so that movement of the intermediate member slides the screw in this slot and thereby moves the face plate toward or away from the wall. Turning the screw moves the face plate vertically.

An important drawback of this approach is that adjustment inwardly and outwardly is not independent of horizontal positioning of the panel, so that the former affects the latter and accurate positioning is therefore made more complex and time consuming.

Another drawback of the approach is that the angle bracket and Z-shaped bracket will physically interfere with the face or cover plate without some specialized adaptation of the face or cover plate. This is important because the angle bracket and Z-shaped bracket are intended to continue supporting the weight of the face or cover plate once it is finally positioned, so that these components must be oversized accordingly. A sizable relief will therefore be required in the face or cover plate and if it is desired to minimize the thickness of the face or cover plate, this may not be accommodable.

Chambers, U.S. Pat. No. 3,715,850 proposes an "adjustable mounting device" including a tubular base insert that can be attached to either a structural steel or reinforced concrete framework and which is in the form of a hollow internally threaded tubular member. An adjustable table plate is connected to the hollow tubular member. The table plate comprises a disc member of circular outer configuration wherein a threaded cantilever stem extends from an inner face thereof. The table plate is provided with a plurality of apertures positioned radially from the central axis thereof. An L shaped bracket has a base flange and a pair of spaced apart attachment flange plates extending perpendicularly in parallel planes. A plurality of horizontally extending aperture pairs are provided in the attachment flange plates and a pair of elongated slots are provided in the base flange. The angle bracket is connected to the table plate by a nut and bolt member passing through one of the elongated slots and the aperture of the respective aperture pairs. By selecting a particular aperture pair or by using any of the apertures in the table plate, the vertical height of the bracket plate is adjustable by eccentric increments of adjustment. The table plate is adjustable inwardly and outwardly by rotating the table plate, threading the cantilever stem inwardly and outwardly through the hollow tubular sleeve.

This approach is not adapted for mounting pre-cast panels to structures. Particularly, the nut and bolt members passing through the elongated slots must support the weight of the panel by frictional force (i.e., tightening of a laterally oriented bolt extending through apertures in the table plate and base flange), making the approach impractical for heavy panels. Another problem with the approach is that vertical adjustment by slots and the alignment of a table plate with pairs of apertures requires more complex hardware and more manual operations than the prior art bolt and pocket. Yet another drawback of the approach is that it provides only discrete increments of adjustment rather than the precise, infinitely variable control provided by the bolt and pocket.

Accordingly, there is a need for a novel and improved method and apparatus for mounting a pre-cast panel to a structure that provides for maintaining the ease, economy and precision of adjustment provided by the prior art bolt and pocket, that provides in addition for adjusting the position of the panel inwardly and outwardly without the disadvantages of the prior art.

SUMMARY OF THE INVENTION

The method and apparatus for mounting a pre-cast panel to a structure of the present invention solves the aforementioned problems and meets the aforementioned needs by providing a pocket in the pre-cast panel extending into a side thereof and having a ceiling surface adapted to rest on a height-adjustable member such as the head of a bolt threadably received in an extendable member attached to a side of the structure to which the panel is to be mounted. The extendable member is carried by a base member mounted to the structure, the base member supporting the extendable member so that the extendable member is enabled to extend along an axis and move inwardly and outwardly relative to the base portion along the axis. Preferably, the extendable member is further constrained by the base member so that the extendable member is not permitted to rotate substantially about the axis.

Typically, for use with structures having vertical walls, the extendable member is oriented along a horizontal axis and the bolt is oriented vertically. Then, with the panel roughly in position, threading the bolt in one direction or the other raises or lowers the panel, to position the panel vertically, and the extending member is adjusted with respect to the base member to position the panel inwardly and outwardly.

Therefore, it is a principal object of the present invention to provide a novel and improved method and apparatus for mounting a pre-cast panel to a structure.

It is a further object of the present invention to provide a method and apparatus for mounting a pre-cast panel to a structure that provides for ease of adjustment of the position of the panel to the structure.

It is still a further object of the present invention to provide such a method and apparatus for mounting a pre-cast panel to a structure that provides for precision of the adjustment.

It is yet a further object of the present invention to provide such a method and apparatus for mounting a pre-cast panel to a structure that provides for economy of manufacture and use.

It is another object of the present invention to provide such a method and apparatus for mounting a pre-cast panel to a structure that provides for minimizing the relief space required in the panel.

It is still another object of the present invention to provide such a method and apparatus for mounting a pre-cast panel to a structure that provides for minimizing the complexity of the components required, especially with respect to panels that are heavy.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 2:
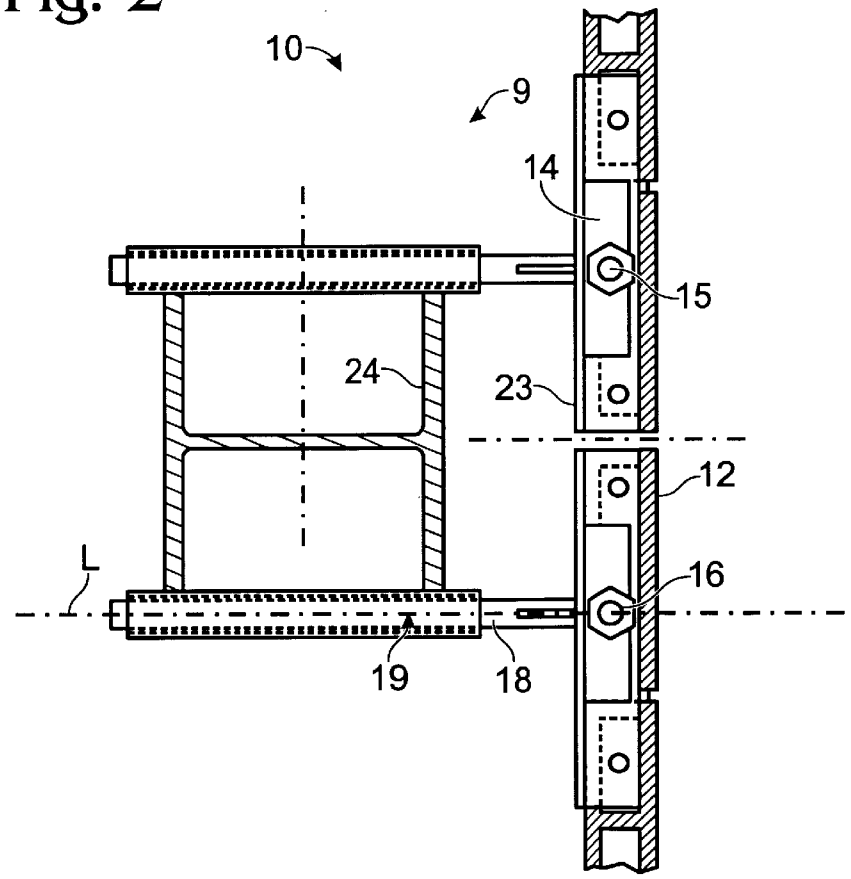
FIG. 2 is a cross-sectional plan view of the apparatus of FIG. 1, taken along a line 2—2.
Figure 1:
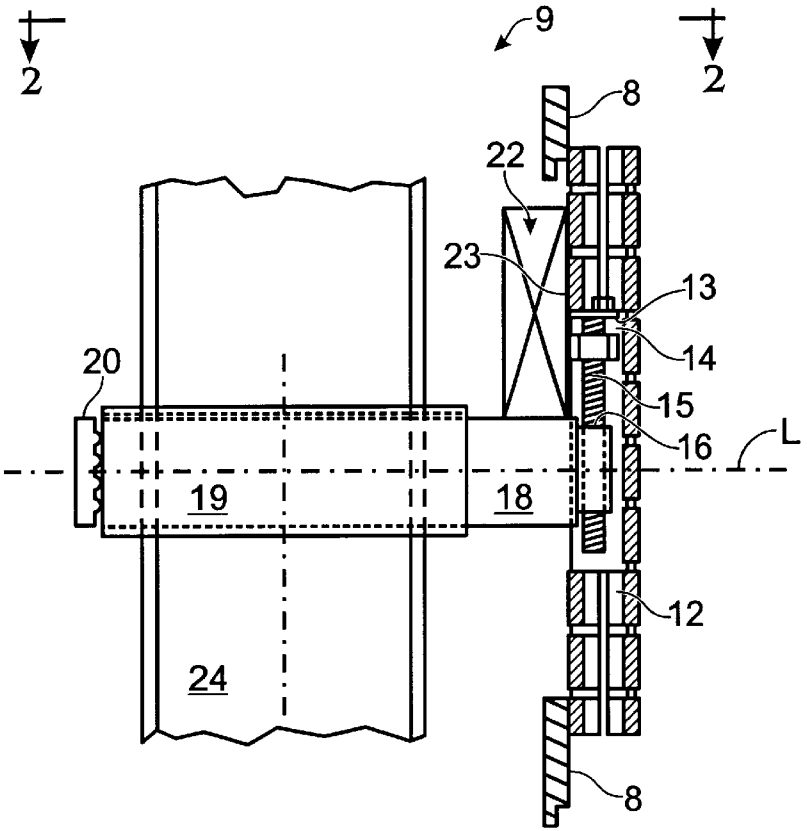
FIG. 1 is a cross-sectional elevational view of an apparatus for mounting a pre-cast panel to a structure according to the present invention.

Referring to FIGS. 1 and 2, an apparatus 10 for mounting a pre-cast panel 12 to a structure 9 according to the present invention is shown. Panels such as the panel 12 are typically decorative, such as a pre-cast concrete or brick facades, and applied to sides of a multi-story building. However, the apparatus 10 may be employed for mounting other types of decorative or structural panels used in or on other types of structures at other locations thereof without departing from the principles of the invention.

The panel 12 may be mounted to a sidewall 8 of the structure, or may function as the sidewall. The panel when mounted to the structure is typically, though not necessarily, oriented vertically.

The panel 12 has a recess or pocket 14 having a ceiling surface 13 which rests on a height-adjustable member 15, which is preferably a vertically aligned bolt. This structure is believed to provide a highly economical height adjusting means. Alternatively, the height-adjustable member could be the piston of a piston and cylinder or a gear driven shaft, or may be other alternative structures or devices providing for vertical height-adjustable as known in the art.

Where the height-adjustable member is a bolt, the bolt is raised or lowered by threading the bolt in a threaded aperture 16. Raising or lowering the bolt raises or lowers the panel which rests thereon at the ceiling surface 13, effecting a vertical position adjustment for the panel. The pocket 14, ceiling surface 13 and height-adjustable member 15 are prior art. Also according to the prior art, the threaded aperture 16 is provided in a stub which extends from the structure 9. Typically, a panel 12 is provided to vertically span a story of the structure, and a corresponding stub is attached to each story floor of the structure.

As best seen in FIG. 1, according to the present invention, the aperture 16 is carried by an extendable member 18 which is supported by a base member 19 so that the extendable member is enabled to extend along an axis "L," and to move inwardly and outwardly with respect to the structure 9 along this axis. The axis "L" optimally lies along a horizontal line in a plane that is perpendicular to the sidewall; however, optimal orientation is not essential for realizing advantages according to the present invention.

Preferably, the base member 19 includes a rectangular tube and the extendable member includes another rectangular tube that is coaxially disposed within the rectangular tube of the base member. In this manner, the extendable member is permitted to extend along the axis "L," yet is constrained by the non-cylindrical shape of the tubes not to rotate about this axis, so that the extendable member is adapted for "nonrotational" linear translation with respect to the base member. This features maintains the vertical disposition of the bolt 15. However, where another height-adjustable member 15 is employed, it may not be necessary to provide this additional constraint on the extendable member.

As persons of ordinary skill in the mechanical arts will immediately recognize, the base and extendable members may adapted and disposed in alternative configurations known in the art providing for reversible linear translation of the extendable member along the axis "L."

The base member 19 is shown in the figures as being attached to a column 24 of the structure 9. However, the base member may be attached to other parts of the structure. Preferably according to the invention, the base member is a concrete floor of the structure, so that it does not interfere with construction of the sidewalls of the structure.

The panel may be positioned simply by pulling or pushing on the panel, thereby causing the extendable member to slide on internal surfaces of the base member 19, depending on frictional contact between the head of the bolt 15 and the ceiling surface 13 to transmit the force to the extendable member. To make this more effective, the head of the bolt may be received in a cavity in the ceiling surface 13, to positively lock the bolt and panel together with respect to forces applied in the direction of the axis "L."

Alternatively, the base and extendable members collectively may be adapted as a gear set driven manually or by use of an engine or motor for controllably moving the extendable member inwardly and outwardly for positioning the panel along the axis "L."More preferably, the extendable and base members may be adapted as a piston and cylinder, for hydraulic or pneumatic extension of the extendable member with respect to the base member. Still more preferably, the extendable and base members may be adapted as a double-acting piston and cylinder, for hydraulic or pneumatic extension and retraction of the extendable member.

Once the desired position of the extendable member 18 is reached and the panel 12 is therefore spaced along the axis "L" in the desired position for mounting the panel, the extendable member is preferably welded to the base member 19, such as at 20, to prevent further movement of the panel along the axis "L." After the desired vertical position of the height-adjustable member 15 is obtained, the height-adjustable member may be similarly prevented from further movement. Preferably, where the height-adjustable member 15 is a bolt, bracing 22 is attached to the extendable or base member and the panel, to relieve the bolt of the requirement to further support the weight of the panel. As one means for forming this attachment, the bracing may be formed of metal and welded to the extendable or base member as well as welded to a metal bracket 23 installed in the pre-cast panel. Other means for forming this attachment as known in the art and as adapted for the materials, configurations and adapations employed in the extendable member, the base member, and the pre-cast panel, may also be used as desired.

It is to be recognized that, while a particular method and apparatus for mounting pre-cast panels to a structure has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

What is claimed is:

1. An apparatus for mounting a panel to a structure, the panel having a recess therein, the apparatus comprising a base member for attachment to a side of the structure, and an extendable member slidably supported by said base member so as to provide for substantially nonrotational, linear translation in a direction perpendicular to the side of the structure, said extendable member having a height-adjustable member at an end thereof adapted to be received by the recess in the panel.

2. The apparatus of claim 1, wherein said height-adjustable member includes a bolt having a head adapted to be received by the recess in the panel and wherein said extendable member includes a corresponding threaded aperture.

3. The apparatus of claim 1, wherein said base member includes a first rectangular tube, and wherein said extendable member includes a second rectangular tube disposed within and extendable from said first rectangular tube.

4. A facade for a structure, comprising a panel having a recess therein, a base member for attachment to the side of the structure, and an extendable member supported by said base member so as to provide for linear translation in a direction perpendicular to the side of the structure, said extendable member having a height-adjustable member received by said recess.

5. The facade of claim 4, wherein said height-adjustable member includes an elongate threaded member and said extendable member includes a corresponding threaded aperture.

6. The facade of claim 4, wherein said base member includes a first rectangular tube, and wherein said extendable member includes a second rectangular tube disposed within and extendable from said first rectangular tube.

7. The facade of claim 5, wherein said base member includes a first rectangular tube, and wherein said extendable member includes a second rectangular tube disposed within and extendable from said first rectangular tube.

8. A method for mounting a panel to a structure, the panel having a recess therein, the method comprising providing an extendable member adapted for substantially nonrotational, linear translation along a first axis, providing a height-adjustable member at an end of said extendable member for independent linear translation along a second axis anti-parallel to said first axis, receiving said height-adjustable member in said recess, and positioning said panel to the structure including at least one of (a) translating the height-adjustable member along said second axis and (b) translating said extendable member along said first axis to adjust the position of the panel with respect to the structure.

9. The method of claim 8, wherein both said steps (a) and (b) are conducted, wherein said step (a) comprises threading said height-adjustable member in a corresponding threaded aperture in said extendable member, and wherein said step (b) comprises sliding said extendable member in a rectangular tube.

10. The method of claim 8, further comprising welding said extendable member in place after completing said step of positioning.

11. The method of claim 10, further comprising attaching bracing to said extendable member and the panel after completing said step of positioning.

12. The apparatus of claim 1, wherein said base member and said extendable member are non-cylindrical.

13. The facade of claim 5, wherein said base member and said extendable member are non-cylindrical.

14. The method of claim 8, wherein both said steps (a) and (b) are conducted, wherein said step (a) comprises threading said height-adjustable member in a corresponding threaded aperture in said extendable member, and wherein said step (b) comprises sliding said extendable member in a non-cylindrical tube.

15. The apparatus of claim 3, wherein said height-adjustable member includes a bolt having a head received by the recess in the panel and wherein said extendable member includes a corresponding threaded aperture.

16. The facade of claim 4, wherein said extendable member is slidably supported by said base member so as to provide for substantially nonrotational, linear translation.

* * * * *